US008632642B2

(12) United States Patent
Butte

(10) Patent No.: US 8,632,642 B2
(45) Date of Patent: Jan. 21, 2014

(54) ADJUSTABLE EXPLOSIVE OUTPUT

(75) Inventor: Ronald J. Butte, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 744 days.

(21) Appl. No.: 12/365,437

(22) Filed: Feb. 4, 2009

(65) Prior Publication Data

US 2010/0192795 A1 Aug. 5, 2010

(51) Int. Cl.

| | |
|---|---|
| ***C06B 47/00*** | (2006.01) |
| ***C06B 45/00*** | (2006.01) |
| ***D03D 23/00*** | (2006.01) |
| ***D03D 43/00*** | (2006.01) |

(52) U.S. Cl.

USPC ..... 149/1; 149/2; 149/108.4; 149/108.8; 149/109.4; 149/109.6

(58) Field of Classification Search

USPC ..... 149/1, 2, 108.4, 108.8, 109.4, 109.6

See application file for complete search history.

(56) References Cited

U.S. PATENT DOCUMENTS

| | | | | |
|---|---|---|---|---|
| 5,007,973 | A * | 4/1991 | Trapp et al. | 149/109.6 |
| 6,283,036 | B1 * | 9/2001 | Munsinger | 102/479 |
| 7,347,906 | B1 * | 3/2008 | Guirguis | 149/14 |

* cited by examiner

*Primary Examiner* — James McDonough

(74) *Attorney, Agent, or Firm* — Schwegman Lundberg & Woessner, P.A.

(57) ABSTRACT

An explosive component includes a first storage container holding a fuel, a second storage container holding an oxidizer, a mixer to mix the fuel and the oxidizer together into an energetic mixture, and a third storage container to hold the energetic mixture.

9 Claims, 4 Drawing Sheets

ADJUSTABLE EXPLOSIVE OUTPUT

TECHNICAL FIELD

Embodiments of the present invention pertain to explosive devices, such as warheads.

BACKGROUND

Explosive devices, such as warheads, are typically designed to provide one outcome after initiation and that is full yield. This can be undesirable, for example, when collateral damage is possible.

Additionally, current warheads have explosive energy from the date of manufacture throughout their lifecycle, creating special handling precautions and inherent danger when exposed to unplanned ignition stimuli, such as fire or bullet impact.

DETAILED DESCRIPTION

The following description and the drawings sufficiently illustrate specific embodiments to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in, or substituted for those of other embodiments. Embodiments set forth in the claims encompass all available equivalents of those claims.

Figure 1:
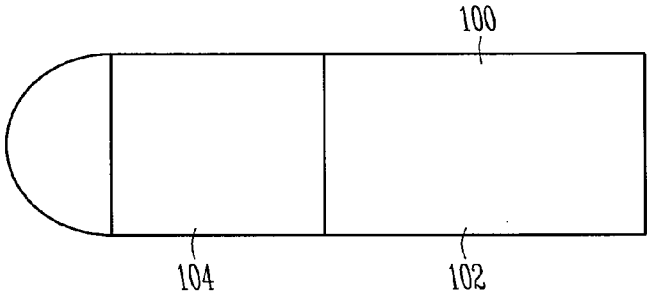
FIG. 1 shows an explosive device, in accordance with one embodiment.

FIG. 1 shows an explosive device 100, such as a warhead, in accordance with one embodiment. Explosive device 100 includes an outer housing 102 and an explosive component 104. In various examples, explosive device 100 can also include various other components within outer housing 100. Explosive device 100 can be used to provide explosive energy and be used in military missions for example.

In one embodiment, explosive component 104 can be a variable output explosive unit. This allows for the user to adjust the explosive output of explosive device 100 as desired. In one embodiment, explosive component 104 can store the fuel and oxidizers used to form an energetic mixture separately from each other until just prior to use. This provides for a low explosive energy system during manufacture and storage and at all times until prior to use.

Figure 2:
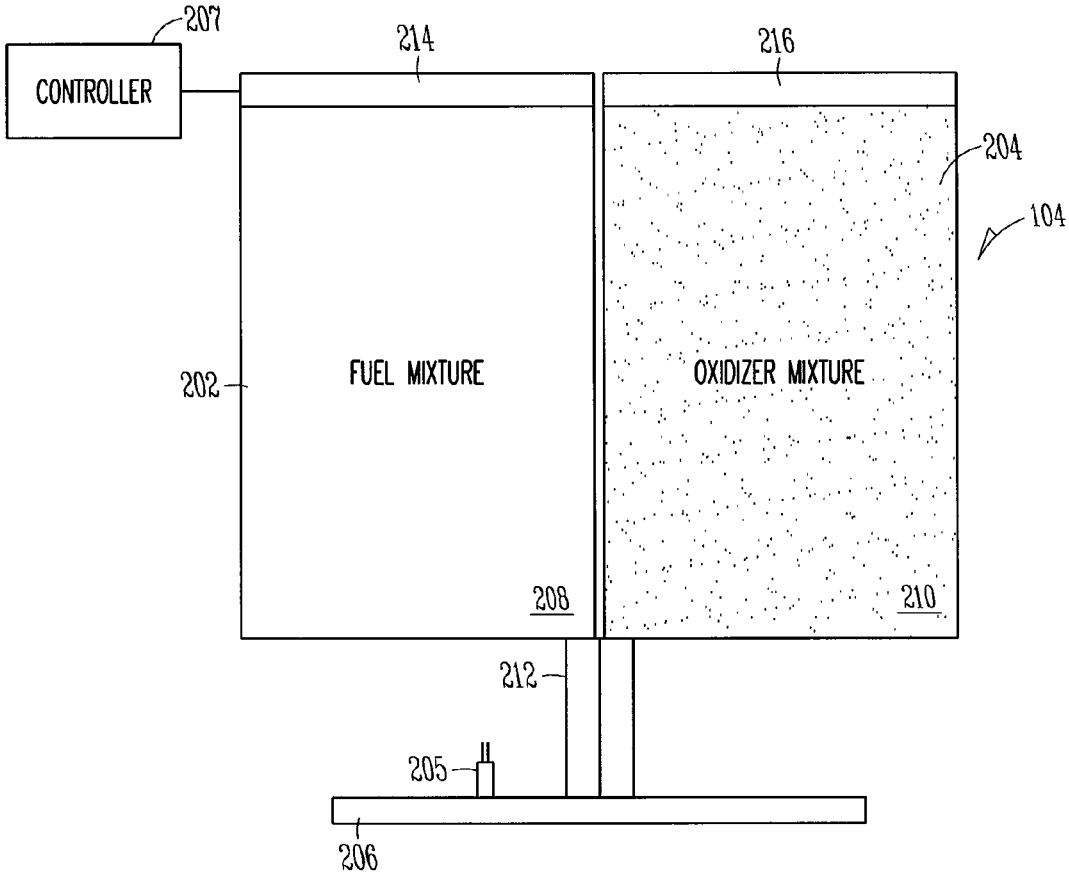
FIG. 2 shows a schematic representation of an explosive component, in accordance with one embodiment.

FIG. 2 shows a schematic representation of explosive component 104, in accordance with one embodiment. In general, explosive component 104 includes a first storage container 202 holding an inert fuel 208, a second storage container 204 holding an inert oxidizer 210, a mixer 212 configured to mix the fuel 208 and the oxidizer 210 together into an energetic mixture, and a third storage container 206 to hold the energetic mixture. A detonator 205 can be operatively coupled to the third storage container and configured to detonate the energetic mixture.

The first and second containers 202, 204 are separated from each other such that the fuel 208 and oxidizer 210 are physically separated until being mixed.

In one embodiment, mixer 212 includes a static mixer. Static mixers have a plurality of fixed elements configured to mix the fuel and the oxidizer together when the fuel and the oxidizer are forced through the static mixer. The static mixer brings the fuel and oxidizer into intimate contact creating an energetic mixture.

In one embodiment, explosive component 104 includes one or more force members 214, 216 to force the fuel 208 from the first storage container 202 and the oxidizer 210 from the second storage container 204 into the mixer 212. In one example, the one or more force members 214, 216 include ram extruders. Force members 214, 216 provide shear to the fuel and oxidizer to force the fuel and oxidizer into the static mixture 212.

A controller 207 can be provided to control the force members 214, 216 so that a pre-determined, selectable amount of fuel 208 and oxidizer 210 are forced into the mixer 212, such that the final energetic mixture has a pre-determined explosive energy. The controller 207 controls the pre-selected amounts of fuel and oxidizer based a desired output of the energetic mixture. For example, after a desired explosive output has been determined, adjustment to the explosive output is made by mixing specific amounts of fuel and oxidizer. The resultant mixture of fuel and oxidizer has explosive energy proportional to the amount of fuel and oxidizer mixed.

Third storage container 206 is operatively connected to the mixer 212 to receive and hold the selected amount of energetic mixture. In some embodiments, third storage container 206 is not a separate container, but instead can include the portion of first storage container 202 and second storage container 204 that is vacated as the fuel mixture 208 and oxidizer 210 are expelled from their respective storage containers.

Figure 3:
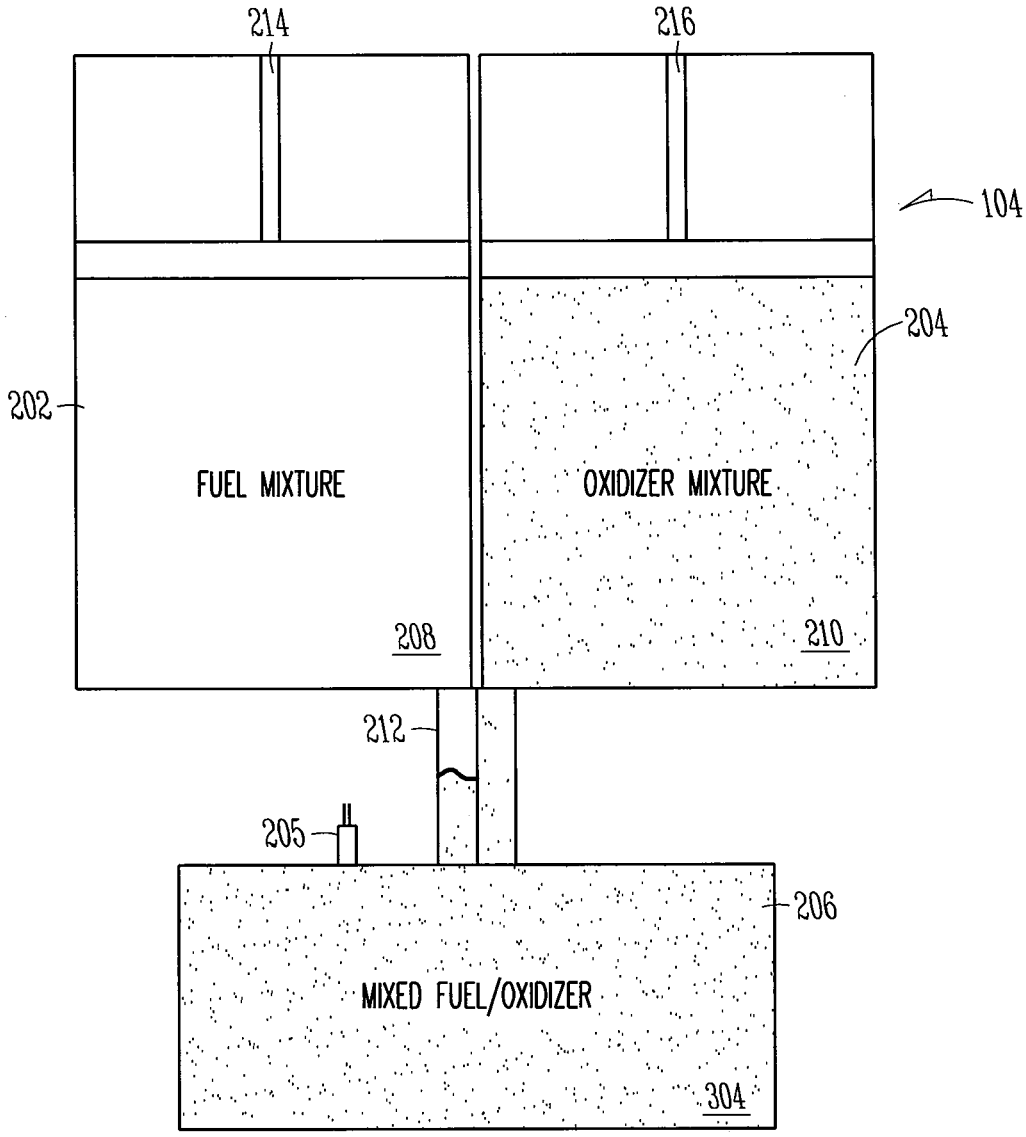
FIG. 3 shows a schematic representation of the explosive component of FIG. 2, in accordance with one embodiment.
Figure 4:
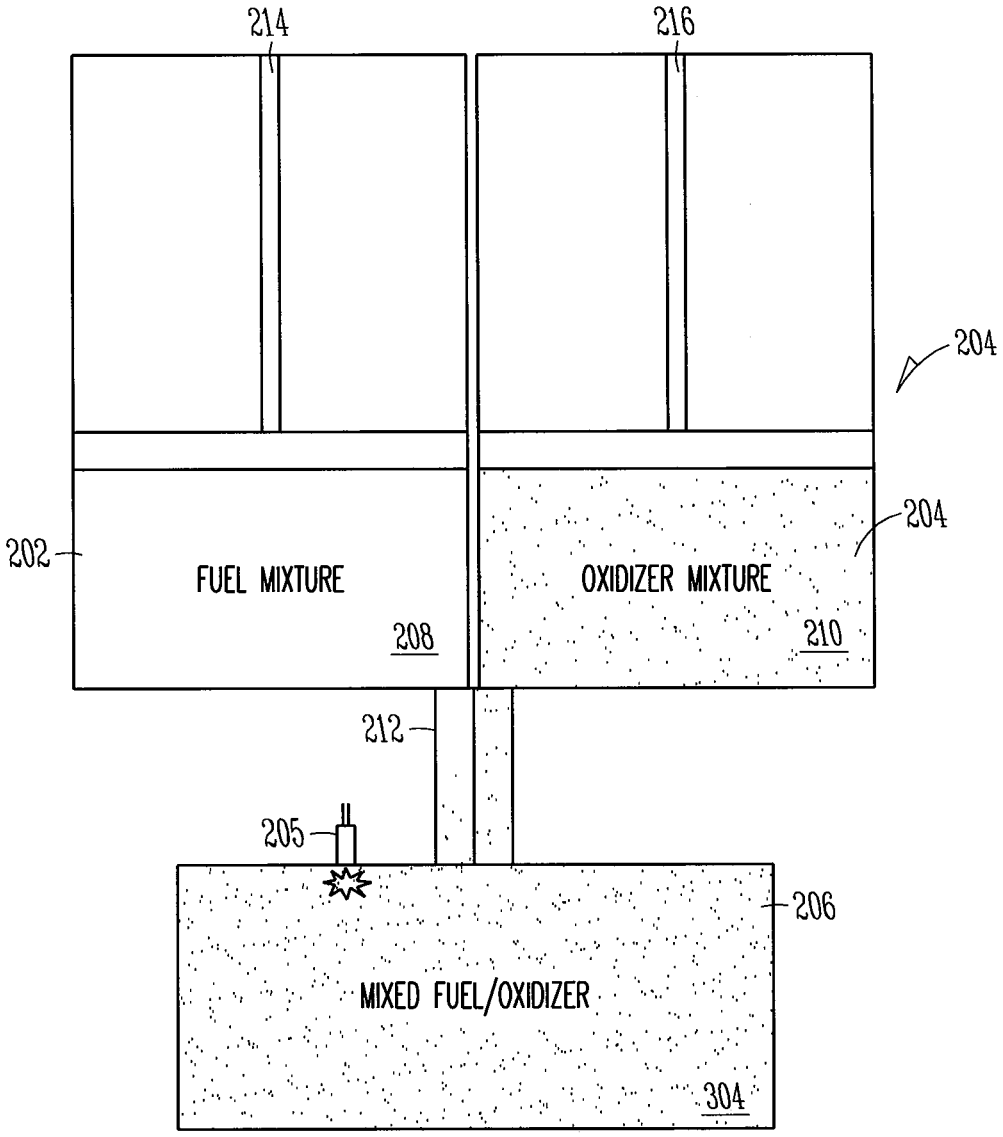
FIG. 4 shows a schematic representation of the explosive component of FIG. 2, in accordance with one embodiment.

FIGS. 2-4 show a schematic depiction of use of explosive component 104, in accordance with one embodiment.

FIG. 2 shows explosive component during manufacture and/or storage. Here, the fuel 208 and oxidizer 210 are kept physically separate. In one example, the fuel and oxidizer 208, 210 are thixotropic mixtures and have the characteristics of solids when not under shear. In addition to fuels such as hydrocarbons and metals, the fuel mixture component 208 can contain energetic material such as HMX or RDX for use in creating a more energetic binary explosive mixture. The oxidizer mixture component 210 can contain materials such as chlorates, perchlorates, nitrites, or nitrates. In addition, each mixture 208, 210 can contain a binder and solvent. In one embodiment, the binder system can be elastomeric, as opposed to cross-linked, and consistent between the fuel and oxidizer mixture. In one embodiment, the solvent dissolves the bonder, but none of the other ingredients. Additional additives such as hydrophobic fumed silica can be added to the mixtures 208, 210 to adjust the flow viscosity and thixotropy.

FIG. 3 shows explosive component 104 during explosive output adjustment, in accordance with one embodiment. For example, after desired output has been determined, adjustment to the explosive output is made. This can occur immediately prior to missile flight or even during missile flight, for example. The fuel and oxidizer 208, 210 are subjected to shear by force members 214, 216, thus lowering the viscosities and allowing flow. For example, this can occur by increasing the pressure on the mixtures 208, 210, such as by ram extrusion. The inert fuel and oxidizer mixtures 208, 210 are brought into intimate contact by mixing in mixer 212 and then stored as an explosive, energetic mixture 304 in storage container 206.

FIG. 4 shows a schematic representation of a final configuration of explosive component 104, in accordance with one embodiment. The resultant mixture 304 of fuel and oxidizer has an explosive energy proportional to the amount of fuel and oxidizer mixed. Output adjustment continues until the desired amount of fuel and oxidizer 208, 210 have been mixed and the desired explosive output is obtained. The mixture 304 is stored in storage container 206. Initiation of the energetic mixture 304 using the detonator 205 releases desired explosive output. The remaining amounts of the inert fuel mixture 208 and inert oxidizer mixture 210 have little or no impact on the explosive impact.

As discussed above, in some examples, third storage container 206 is not a separate container, but instead storage container 206 can include the portions of first storage container 202 and second storage container 204 that are vacated as the fuel mixture 208 and oxidizer 210 are expelled from their respective storage containers. For example, the area of containers 202 and 204 located above force members 214, 216 can be connected to the end of mixer 212 such that the mixture 304 is delivered into and stored within that vacated volume. Detonator 205 can be coupled to that portion of the device, in that embodiment.

Figure 5:
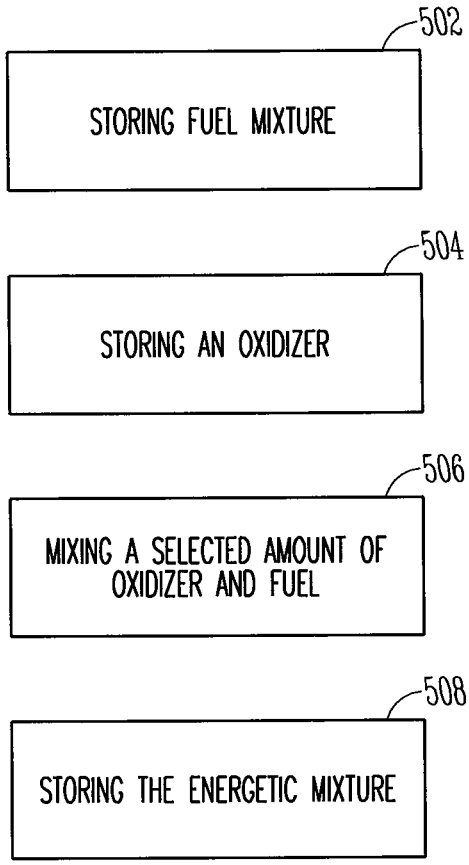
FIG. 5 shows a method of using an explosive component, in accordance with one embodiment.

A method is depicted in FIG. 5 showing a representation of use of the explosive component discussed above. The method includes storing a fuel in a first container (502), storing an oxidizer in a second container (504), mixing a selected amount of the fuel and a selected amount of the oxidizer into a selected amount of energetic explosive mixture (506), and storing the energetic explosive mixture in a third container (508).

Referring again to FIGS. 2-4, the controller 207 is configured to control an amount of force exerted by the force members 214, 216 to provide the selected amounts of fuel and oxidizer. During use, the fuel and oxidizer are mixed either just prior to launch or during flight and the selectable amounts of fuel and oxidizer are adjustable based on an intended target.

As discussed above, during manufacture, and at all times prior to use, the explosive component 204 has low or no explosive energy because the fuel component and the oxidizer component are physically separated and are not stored in a mixed condition. Storing the fuel and oxidizer separately also significantly decreases the effects of long term or high-temperature aging on the explosive output and stability. Storing the fuel and oxidizer separately is inherently safe for handling, and when exposed to unexpected initiation sources such as fire or bullet impact. Output adjustment can be made immediately prior to, or even during, missile/warhead flight due to the thixotropic nature of the mixtures which will not mix if the containers are breached and will not react if they come into contact with another.

The present disclosure relates in general to explosive charges. In one embodiment, it relates to explosive charges where the explosive charge can be adjusted on demand to various degrees. In one embodiment, it relates to explosive charges where the explosive charge can optimally perform in various missions aimed at defeating air, surface, and shallow underground/underwater targets. Some embodiments provide an explosive charge and warhead design that is capable of performing optimally in multiple missions and provide the option of adjusting the output on demand, such as immediately before use.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An explosive device comprising:

a launchable missile including a housing;

a first storage container within the housing and holding a thixotropic fuel mixture;

a second storage container within the housing and holding a thixotropic oxidizer mixture;

a static mixer within the housing operatively connected to the first and second storage containers to mix the thixotropic fuel mixture and the thixotropic oxidizer mixture into an energetic mixture;

one or more force members to force a selected amount of the thixotropic fuel mixture and a selected amount of the thixotropic oxidizer mixture from their respective storage containers into the static mixer;

a third storage container located within the housing and connected to the mixer to hold the energetic mixture, wherein the third storage container includes a portion of the first storage container and the second storage container that is vacated by the fuel and oxidizer forced into the static mixer; and a detonator operatively coupled to the third storage container and configured to detonate the energetic mixture.

2. The explosive device of claim 1, wherein the one or more force members include ram extruders.

3. The explosive device of claim 1, including a controller to control the selected amounts of fuel and oxidizer based a desired output of the energetic mixture, wherein the controller controls an amount of force exerted by the force members to provide the selected amounts of fuel and oxidizer.

4. The explosive device of claim 3, wherein the fuel and oxidizer are stored separately, wherein the fuel and oxidizer are mixed either just prior to launch or during flight, and wherein the selectable amounts of fuel and oxidizer are adjustable based on an intended target.

5. An explosive device comprising:

a launchable missile including a housing;

a first storage container within the housing and holding a thixotropic fuel mixture;

a second storage container within the housing and holding a thixotropic oxidizer mixture;

a static mixer within the housing operatively connected to the first and second storage containers to mix the thixotropic fuel mixture and the thixotropic oxidizer mixture into an energetic mixture;

one or more force members to force a selected amount of the thixotropic fuel mixture and a selected amount of the thixotropic oxidizer mixture from their respective storage containers into the static mixer;

a third storage container located within the housing and connected to the mixer to hold the energetic mixture;

a detonator operatively coupled to the third storage container and configured to detonate the launchable missile including the entire explosive device; and wherein the explosive device provides storage, mixed and detonation configurations:

in the storage configuration the first and second storage containers respectively store the thixotropic fuel and oxidizer mixtures, in the mixed configuration at least portions of the thixotropic fuel and oxidizer mixtures are mixed and stored in the third storage container within the housing of the launchable missile, and the third storage container includes a portion of the first storage container and the second storage container that is vacated by the fuel and oxidizer forced into the static mixer, and in the detonation configuration, the detonator detonates the energetic mixture and destroys the launchable missile including the housing, the first, second and third storage containers and the static mixer.

6. The explosive device of claim 5, wherein the one or more force members include ram extruders.

7. The explosive device of claim 5, including a controller to control the selected amounts of fuel and oxidizer based a desired output of the energetic mixture, wherein the controller controls an amount of force exerted by the force members to provide the selected amounts of fuel and oxidizer.

8. The explosive device of claim 7, wherein the fuel and oxidizer are stored separately, wherein the fuel and oxidizer are mixed either just prior to launch or during flight, and wherein the selectable amounts of fuel and oxidizer are adjustable based on an intended target.

9. The explosive device of claim 1, wherein the explosive device provides storage, mixed and detonation configurations:

in the storage configuration the first and second storage containers respectively store the thixotropic fuel and oxidizer mixtures, in the mixed configuration at least portions of the thixotropic fuel and oxidizer mixtures are mixed and stored in the third storage container within the housing of the launchable missile, and in the detonation configuration, the detonator detonates the energetic mixture and destroys the launchable missile including the housing, the first, second and third storage containers and the static mixer.

* * * * *